US006499463B1

(12) United States Patent
Berriman et al.

(10) Patent No.: US 6,499,463 B1
(45) Date of Patent: Dec. 31, 2002

(54) DUAL FUEL SOURCE DIESEL ENGINE

(75) Inventors: Lester Berriman, Irvine, CA (US); John Zabsky, Santa Ana, CA (US)

(73) Assignee: KleenAir Systems, Inc., Irvine, CA (US)

( * ) Notice: Subject to any disclaimer, the term of this patent is extended or adjusted under 35 U.S.C. 154(b) by 0 days.

(21) Appl. No.: 10/147,610

(22) Filed: May 16, 2002

Related U.S. Application Data

(60) Provisional application No. 60/306,713, filed on Jul. 20, 2001.

(51) Int. Cl.[7] ..... F02B 19/10
(52) U.S. Cl. ..... 123/431
(58) Field of Search ..... 123/431, 27 R, 123/430, 429, 279 E

(56) References Cited

U.S. PATENT DOCUMENTS 2,221,405 A * 11/1940 Nallinger ..... 123/198 A
2,534,346 A * 12/1950 Fenny ..... 123/1 R
3,924,598 A * 12/1975 Davis ..... 123/299
6,314,940 B1 * 11/2001 Frey et al. ..... 123/430

* cited by examiner

*Primary Examiner*—Bibhu Mohanty
(74) *Attorney, Agent, or Firm*—Leon D. Rosen

(57) ABSTRACT

In the operation of a diesel engine, a mixture of air and fuel is flowed into each cylinder during the intake stroke when air alone normally would be flowed in. However, the mixture is lean so it does not ignite as the mixture is compressed and heated. Sufficient additional fuel is injected into the cylinder near the top of the compression stroke to increase the amount of fuel so the hot mixture ignites. As a result, most of the air and fuel has intimately mixed prior to ignition.

8 Claims, 2 Drawing Sheets

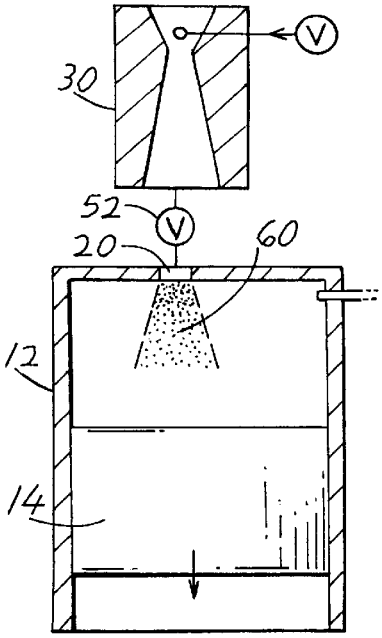
FIG. 4
INTAKE STROKE
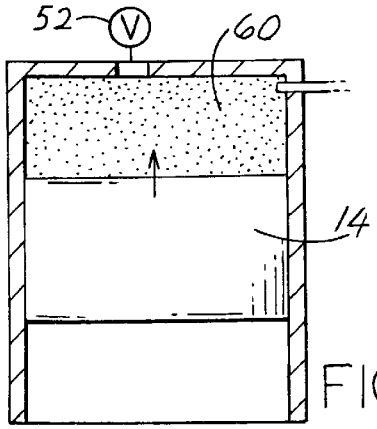
FIG. 5
COMPRESSION STROKE
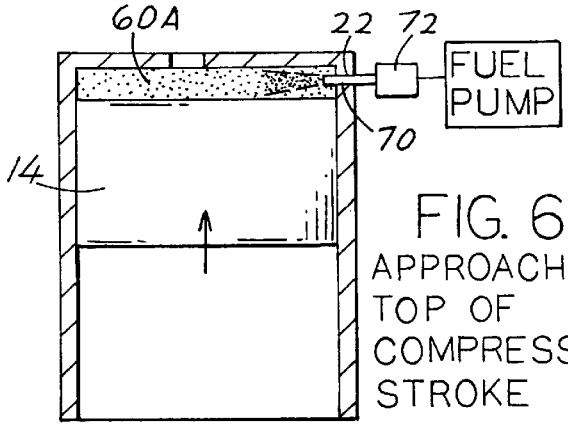
FIG. 6
APPROACHING TOP OF COMPRESSION STROKE
FIG. 7
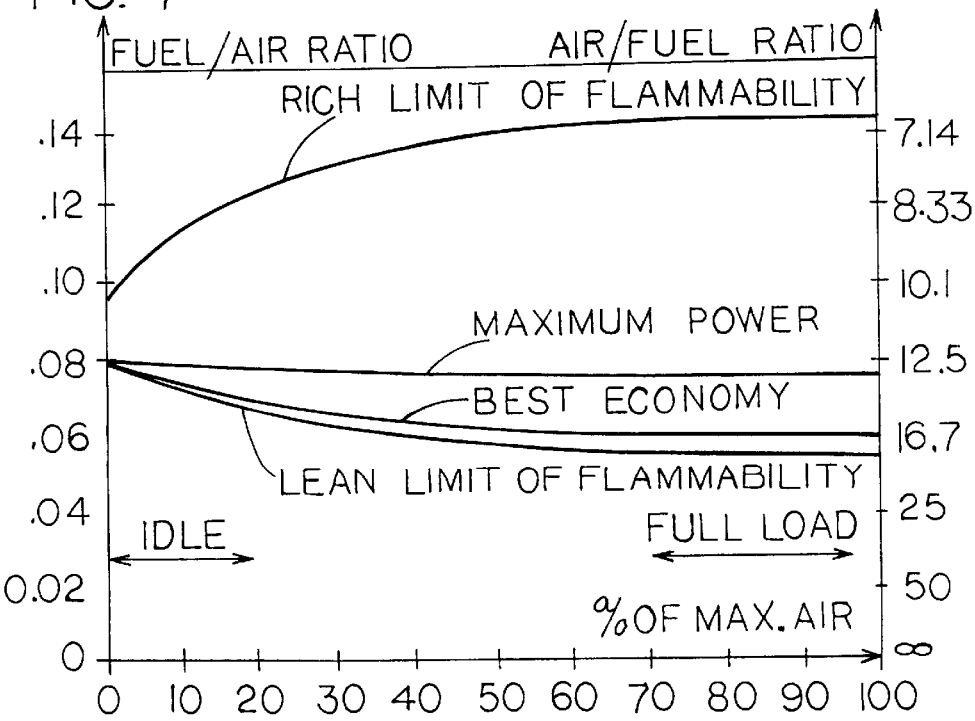

DUAL FUEL SOURCE DIESEL ENGINE

This application claims the benefit of Provisional Application No. 60/306,713, filed Jul. 20, 2001.

BACKGROUND OF THE INVENTION

Diesel engines normally operate by flowing air into each cylinder during the intake stroke, and compressing the air to a high temperature during the compression stroke. At the end of the compression stroke, fuel is injected into the compressed and heated air, and it immediately ignites to produce high pressures that are used during the subsequent power stroke. During the very short time between injection of fuel and an early portion of the power stroke, there is poor mixing of fuel and air. This results in incomplete burning of fuel and consequent unburned hydrocarbons, leading to a reduction of efficiency and an increase in pollution components that must be removed or which contaminate the environment. In an ignition engine, a critical mixture of fuel and air is flowed into each cylinder during the intake stroke, or air is flowed in and fuel is injected, with a spark applied at the top of the compression stroke to produce power. In both cases, the air-fuel ratio should be between about 7 and 18 at moderate to full load to assure that the mixture will burn, either when fuel is injected or when a spark is applied.

In a diesel engine, the compression ratio is between about 12:1 and 22:1, with almost all diesel engines for vehicles using a ratio of about 16:1 to 18:1. In spark ignition engines, the compression ratio is between 6:1 and 12:1, with almost all spark ignition engines used on automobiles having a compression ratio of about 7.5:1 to 8.5:1. While the much higher compression ratio of a diesel engine results in greater efficiency, the increase in unburned hydrocarbons and resulting pollution is a major disadvantage of diesel engines. If the amount of unburned hydrocarbons in diesel engines could be reduced, this would significantly increase the acceptability of such engines.

SUMMARY OF THE INVENTION

In accordance with one embodiment of the present invention, an engine with a high compression ratio is provided wherein fuel and air are more throughly mixed for better efficiency and lower pollution. The engine has a compression ratio of at least 12:1 which is typical for diesel engines. Instead of flowing only air into each cylinder during the intake stroke, applicant supplies a subcritical mixture of finely atomized fuel in air into each cylinder. The subcritical mixture has an air-fuel ratio such as more than 18:1, so it will not ignite when heated to the high temperature achieved near the-end of the compression stroke. However, near the end of the compression stroke, fuel is injected into the hot, compressed and lean air-fuel mixture to create a critical mixture that immediately ignites to produce high pressure gasses for the power stroke.

The air-fuel mixture that is admitted into each cylinder during the intake stroke preferably contains more than half the fuel that is consumed in each cycle of operation. Although each stroke of the piston may use almost the same total amount of fuel as a present diesel engine, much of the fuel is atomized and well mixed with the air at the time that additional fuel is injected and ignition occurs. The fuel that was originally introduced during the intake stroke will burn substantially completely and cleanly, resulting in a higher percentage of the fuel being burned. This results in greater efficiency and a lower percent discharge of unburned fuel particles.

The novel features of the invention are set forth with particularity in the appended claims. The invention will be best understood from the following description when read in conjunction with the accompanying drawings.

BRIEF DESCRIPTION OF THE DRAWINGS

FIG. 4 is a schematic diagram of the engine of FIG. 1, shown during an intake stroke.

FIG. 5 is a view similar to FIG. 4, during a compression stroke.

FIG. 6 is a view similar to that of FIG. 5, near the top of a compression stroke.

FIG. 7 contains graphs showing limits of flammability of air-fuel mixtures for common internal combustion engine fuels.

DESCRIPTION OF THE PREFERRED EMBODIMENTS

Figure 1:
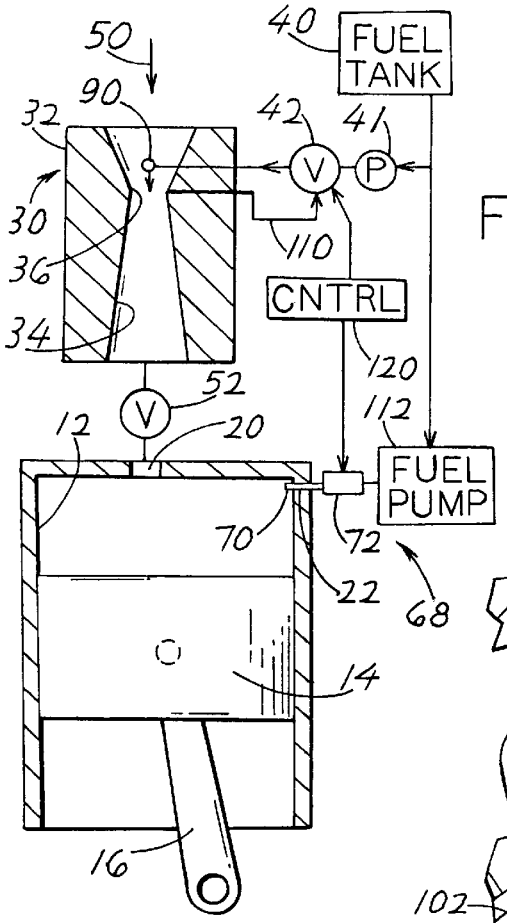
FIG. 1 is a sectional and schematic diagram of a portion of an engine of the present invention.

FIG. 1 illustrates a portion of an engine of the present invention, which includes the usual cylinder 12 (only one of perhaps six is shown) and piston 14 that moves up and down in the cylinder and that connects through a piston rod 16 to a crank shaft. The engine is similar to a diesel engine, with an air intake 20 and a fuel injection port 22 near the top of the cylinder.

In a typical diesel engine, air is introduced into the cylinder through the air intake 20 during the downward intake stroke of the piston. In the present invention, a finely divided mixture of air and fuel is introduced through the air intake during the downward intake stroke. The air-fuel mixture is obtained through a mixer device 30 which includes a frame 32 that forms a passage 34 with a throat 36. Fuel from a fuel tank 40 passes through a pump 41 and a valve 42 to a tube 90 that has an aperture that is opened to a location upstream from the throat 36. Air moves along the direction of arrow 50 through the passage and is mixed with fuel from tube 90, and the atomized air-fuel mixture passes through a valve 52 through the air intake 20 into the cylinder (or into a manifold leading to cylinders). Thus, instead of only air passing into the cylinder during the intake stroke of the piston, applicant supplies a mixture of fuel and air. The movement of fuel and air through the throat 36 of the mixer device results in sonic speed movement and in atomization of the fuel droplets, resulting in a "fog" of very fine droplets disbursed in the air.

FIG. 4 shows a first step in the cycle of operation of the engine, during the intake stroke when the piston 14 is moving down. As mentioned above, a fine mixture of fuel and air is produced by the mixer device 30 and passes through the air intake 20 into the cylinder 12.

FIG. 5 shows a later stage in the cycle of operation of the engine, when the valve 52 at the air intake is closed, and the piston 14 is moving upward during the compression stroke. The air-fuel mixture 60 above the cylinder, is being compressed and rises in temperature during such compression. However, the air-fuel mixture 60 does not ignite because it is lean in that the ratio of air to fuel is considerably greater than the minimum of about 18:1 required to ignite such a mixture at the temperature and pressure attained during the compression stroke.

FIG. 6 shows a later stage in the compression stroke, as the piston 14 approaches the top of the cylinder and a fuel injection system 68 injects fuel into the cylinders. At that time, fuel is injected through a nozzle 70 of a fuel injector 72 through the cylinder port 22 into the cylinder, and into the highly compressed lean mixture of air and fuel at 60A. The injected fuel is immediately ignited as it enters the hot lean fuel air mixture 60A to ignite the mixture and the injected fuel. The piston 14 then moves down under the very high pressure of the ignited air-fuel mixture, to produce the power stroke. The power stroke is followed by an up stroke to pump out the gasses through an exhaust port and valve, and the intake stroke shown in FIG. 4 of the next cycle begins again. If the engine has just been started and is cold, a glow plug at the top of the cylinder is energized to ignite the mixture.

The amount of fuel injected by the injector 72 when the piston is near the top of its compression stroke, is much less than would be injected by the same engine if only air was present before fuel injection. Instead, only enough fuel is injected in FIG. 6 through the injector 72, so that the amount of fuel in the fuel air mixture at 60A plus the additional fuel injected through the injector 72, is about equal to (or somewhat less than) the amount of fuel that would be injected in a prior diesel engine (when all fuel was injected near the top of the compression stroke).

Although the amount of fuel used in each cycle of engine operation may be about the same as previously, when fuel was applied only through injection, the cycle of FIGS. 4–6 results in improvements. One improvement is that the airfuel mixture 60 admitted through the intake stroke results in that fuel being finely mixed with the air because of the fog produced by the mixer device 30 and because of a longer amount of time that the fuel and air in the mixture or fog 60 remain in contact. Actually, much of the fuel evaporates into the air. The flow in of the mixture results in a high proportion of fuel in the mixture 60 in the cylinder burning, so the fuel produces more power and less pollutants (e.g. unburned hydrocarbons). The additional fuel injected in FIG. 6 through the injector 72 might be expected to behave in the same manner as fuel injected into solely air, although there can be better mixing because less fuel is injected through the injector 72 in the step of FIG. 6.

It is noted that in a non-diesel (otto cycle or spark ignition) engine, commonly used in automobiles, the compression ratio is usually about 7:1 to 9:1. A higher ratio may result in the air-fuel mixture exploding prior to ignition by a spark plug, resulting in "knocking", even with high octane fuel. Applicant can use the common diesel compression ratio of at least about 12:1, and usually 16:1 to 18:1 without premature explosion during compression because the air-fuel mixture received from the mixer device 30 during the intake stroke is very lean.

FIG. 7 is a graph showing maximum and minimum mixture ratios to obtain ignition of fuel air mixtures. Although this graph was made for spark-ignition engines, the ratios are close for diesel engines wherein higher compression ratios are used. It can be seen that to obtain ignition of an air-fuel mixture, the air-fuel ratio should be less than about 17 at medium to full loads. Applicant provides an air-fuel ratio greater than 18 into the air intake 20 (FIG. 4), to avoid premature ignition of the mixture as it is being compressed and heated. Applicant prefers that the air-fuel ratio be less than 35:1, so that at least half, and preferably more, of the fuel burned in each cycle of engine operation, is obtained through the air inlet 20 of FIG. 4. Consequently, the amount of fuel injected into the cylinder in each cycle is preferably less than half of the total fuel used in each cycle. Actually, applicant prefers to have the air-fuel mixture admitted through the air intake 20, comprise more than 75% of the total fuel used in each cycle, and preferably even more. The main consideration is that the mixture not ignite until additional fuel is injected through the fuel injector. The fuel injector injects at least about 5% of the fuel, to reliably lower the air-fuel mixture from above to below critical.

Figure 3:
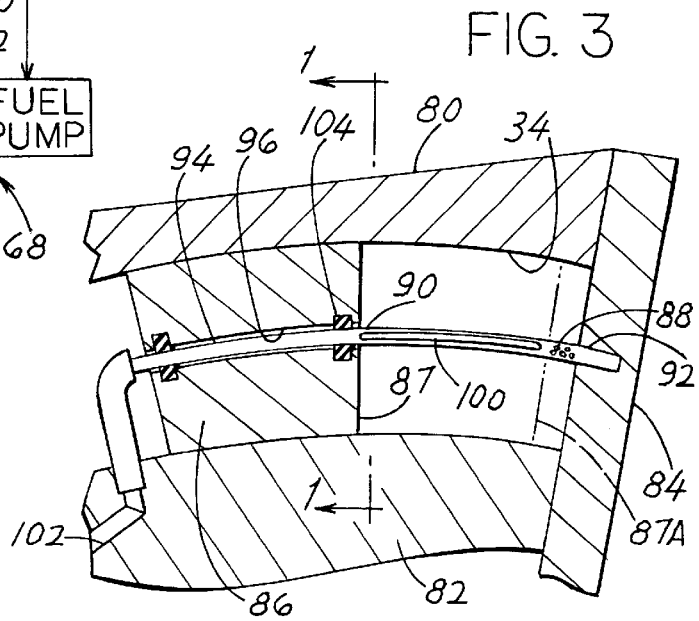
FIG. 3 is a partial sectional view taken on line 3—3 of FIG. 2.
Figure 2:
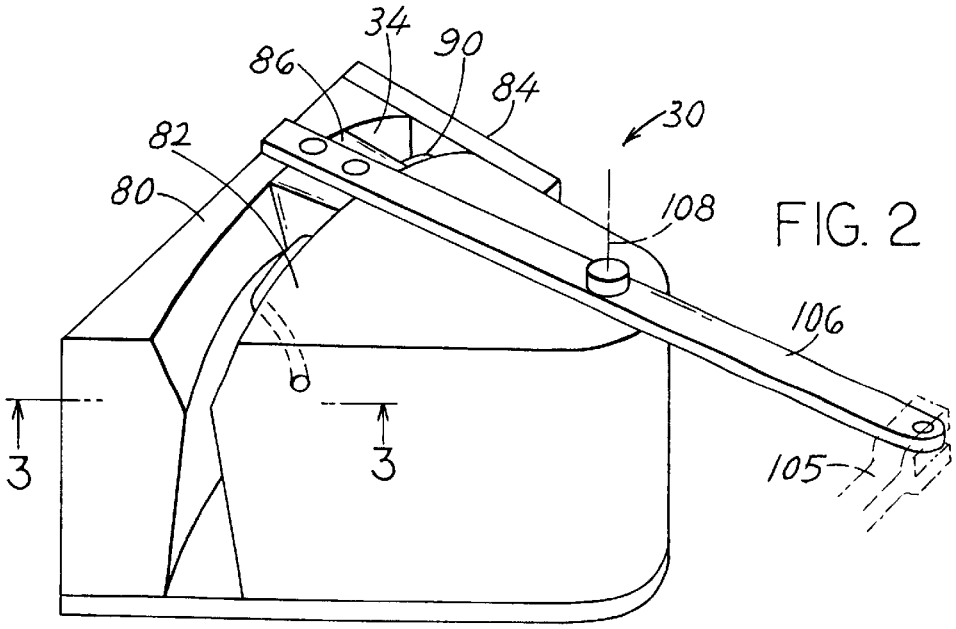
FIG. 2 is an isometric view of an air-fuel mixer of FIG. 1.

In a standard diesel engine, when more power is required from the engine, more fuel is injected through the fuel injector 72 (FIG. 6) in each cycle of operation. When all fuel comes through the injector 72, this can be done. However, when a large portion of the fuel comes through the mixer device 30, then the mixer device 30 must allow a widely variable amount of fuel and air to flow into the cylinder. FIGS. 2 and 3 show some details of the mixer device 30 which can supply a variable amount of an air-fuel mixture while maintaining an approximately constant (or controlled) ratio of fuel to air. The mixer device includes stationary opposite side walls 80, 82, and a moveable wall 86 that can move toward and away from the stationary end wall 84. The passage 34 through which fuel and air moves, is formed between these four walls. The fuel carrying tube 90 has a proximal end 92 fixed to the stationary end wall 84 and has a distal portion 94 that extends through a bore 96 in the moveable wall 86. The tube has a slit-shaped aperture 100 for flowing fuel into the passage. In the idle condition of the engine, the proximal end 87 of the moveable wall lies at position 87A wherein a small amount of fuel is dispersed through holes 88.

When the moveable wall 86 moves away from the stationary end wall 84, the open area of the tube aperture 100 progressively increases, to flow progressively more fuel into the passage 34. Pressured fuel is pumped to the tube through a fixed conduit 102. Portions of the aperture 100 that are not exposed to the passage 34 are sealed by a seal 104. Thus, the total cross-section of the passage 34 can be increased and decreased to flow more or less air to the engine cylinder, and the amount of fuel flowing into the passage 34 increases and decreases as the amount of air increases and decreases. Movement of the moveable wall 86 is accomplished by a throttle lever 105 that pivots a mixer device lever 106 that is pivotally mounted at an axis 108 on the mixer frame.

If more power is required from the engine, the moveable wall 86 is moved away from the wall 84, to simultaneously increase the amount of fuel and the amount of air. The cross section of the passage as seen in FIG. 1, does not change. As a result, the same shape of the passage, with the throat 36 that results in sonic flow-through and in corresponding atomization of the liquid fuel injected through the tube 90, continues for all ranges of spacing of the moveable wall 86 from the opposite end wall 84. In FIG. 1, the valve 42 controls fuel flow, depending upon the air pressure above the throat 36, as sensed through a line 110. It is also noted that the same fuel from the tank 40 passes through a controllable fuel pump 112 that delivers fuel to the fuel injector 72. The rate of flow of fuel through the injector 72 near the end of each compression stroke, is controlled by prior art controls.

The system of the invention can be easily retrofitted to an existing diesel engine. This is accomplished by adding the mixer device 30 along with the valve 42 and other connections to the fuel tank, so that instead of solely air being delivered through the valve 52 to the air intake 20 of the cylinder, the airfuel mixture from the device 30 is supplied. In addition, a control 120 (as by modifying the existing control) is coupled to the fuel injector 72 to reduce the amount of fuel that is injected for comparable engine power requirements. It is noted that in a supercharged engine, the pressured air can be applied along the air path 50 in FIG. 1 that passes through the mixer device.

Thus, the invention provides a fuel source for a diesel engine, wherein a finely atomized air-fuel mixture is delivered to the cylinder (each cylinder of a multi-cylinder engine) during the intake stroke of the piston. An additional amount of fuel is injected into the cylinder as the piston approaches the top of its compression stroke (and/or afterward). The sum of the fuel supplied during the intake stroke when the atomized air-fuel mixture is supplied and the fuel injected near-the top of the compression stroke, may be about equal to, or slightly less than, the fuel previously applied in each cycle solely through the fuel injector. The air-fuel ratio of the mixture admitted through the air intake, is preferably less than 35:1, so most of the fuel supplied to the cylinder is supplied through the previously-mixed air-fuel mixture, and only a minority of the fuel is supplied through the fuel injector. Preferably, at least 75% of the total fuel used in each cycle, is applied through the air intake.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An engine which includes a plurality of cylinders, a plurality of pistons each slideable in one of said cylinders to compress fluid in the cylinder to a maximum compression ratio in each cycle, an air-intake opening that opens to each cylinder, and a fuel injector opening that opens to each cylinder, comprising:

an air-fuel mixer coupled to each of said air-intake openings, which supplies a mixture of fuel and air to the cylinder;

a fuel injector system coupled to each of said fuel injector openings to inject fuel into each cylinder;

said air-fuel mixer being constructed to supply an air-fuel mixture that contains over 10% of the fuel used in each cycle, but that is sufficiently lean to avoid detonation or ignition of the air-fuel mixture at said maximum compression ratio;

said fuel injector system is constructed to inject a plurality of the percent of fuel used in each cycle.

2. The engine described in claim 1 wherein said engine is a diesel-type engine with a compression ratio of at least 12, and wherein:

said air-fuel mixer is constructed to supply said mixture at an air to fuel ratio that is no more than 35 to 1, and said fuel injector system is constructed to inject sufficient fuel to lower the air to fuel ratio to no more than about 17 to 1.

3. The engine described in claim 1 wherein:

said fuel injector system is constructed to inject at least about 5% of the fuel used in each cycle.

4. An engine which includes a plurality of cylinders, a plurality of pistons (14) each slideable in one of said cylinders in a cycle that includes a compression stroke wherein the maximum compression ratio is at least 12 to 1 and that includes a power stroke, comprising:

an air-fuel mixer that flows a subcritically lean mixture of fuel and air to each cylinder prior to each power stroke, wherein said subcritically lean mixture contains insufficient fuel to cause self ignition at said compression ratio;

a fuel injector system (68) that injects fuel into each of said cylinders to raise the level of fuel to a critical level wherein ignition of the mixture occurs at said compression ratio achieved during said compression stroke.

5. The engine described in claim 4 wherein:

said maximum compression ratio is between about 16:1 and 18:1;

said subcritical lean mixture contains an air to fuel ratio of at least about 18 but no more than about 35 so at least half of the required fuel is supplied in the mixture and less than half need be supplied by fuel injection.

6. The engine described in claim 4 wherein:

said air-fuel mixer is constructed to supply at least half of the fuel required to produce a critical mixer that ignites at a compression ratio of about 17.1, and said fuel injector is constructed to supply at least 5% of the fuel required to produce such critical mixture.

7. A method for operating a diesel engine which includes a plurality of cylinders, a plurality of pistons each slideable in one of said cylinders in a cycle that includes a compression stroke wherein the maximum compression ratio is at least 12 to 1, comprising:

mixing air and fuel to generate an air to fuel ratio that is greater than that at which self ignition can occur at close to said maximum compression ratio, and flowing the mixture into said cylinders in each cycle;

injecting fuel into the mixture lying in each cylinder to lower the air-fuel ratio to cause ignition of the air and fuel mixture at the maximum compression and temperature that occurs in the cylinders prior to ignition.

8. The method described in claim 7 wherein said step of mixing air and fuel includes creating an air to fuel ratio that is greater than about 18 and flowing said mixture into each cylinder;

said step of injecting fuel includes injecting sufficient fuel to lower the air fuel ratio to less than about 17.

* * * * *